United States Patent [19]

Thompson

[11] 4,015,389

[45] Apr. 5, 1977

[54] CEILING SYSTEM AND PREFABRICATED OVERHEAD BUILDING ASSEMBLY USING THIS SYSTEM

[75] Inventor: Neil Jay Thompson, Palatine, Ill.

[73] Assignee: Johns-Manville Corporation, Denver, Colo.

[22] Filed: Apr. 17, 1975

[21] Appl. No.: 569,111

[52] U.S. Cl. ..... 52/475; 52/126; 52/732; 52/496

[51] Int. Cl.[2] ..... E04B 5/52; E04C 3/30

[58] Field of Search ..... 52/475, 28, 484, 714, 52/758, 758 F, 126, 485, 732, 496; 85/3 R, 1 R, 32 R

[56] References Cited

UNITED STATES PATENTS

| | | | |
|---|---|---|---|
| 2,795,130 | 6/1957 | Pritchett | 85/3 R |
| 3,066,775 | 12/1962 | Valsvik | 52/483 |
| 3,389,631 | 6/1968 | Vaillancourt | 85/3 R |
| 3,450,871 | 6/1969 | Segil et al. | 52/588 |
| 3,455,198 | 7/1969 | Barrett | 85/1 R |
| 3,696,569 | 10/1972 | Didry | 52/732 |
| 3,696,571 | 10/1972 | Schluter | 52/496 |
| 3,848,385 | 11/1974 | Thompson | 52/484 |
| 3,898,782 | 8/1975 | Donato | 52/496 |

*Primary Examiner*—Price C. Faw, Jr.
*Assistant Examiner*—Robert C. Farber
*Attorney, Agent, or Firm*—Robert M. Krone; Joseph J. Kelly; Stephen C. Shear

[57] ABSTRACT

A prefabricated overhead building assembly and components making up this assembly are disclosed herein. The assembly includes a prefabricated overhead building structure, for example, a prefabricated roof, and a suspended ceiling system connected to and directly under the overhead structure. This ceiling system is comprised of a number of support runners and connectors which connect the support runners together to form a ceiling support grid supporting, for example, ceiling tile. The ceiling system also includes arrangements of cooperating components which fixedly connect the support grid to the overhead structure at alternative spaced positions below the overhead structure.

14 Claims, 4 Drawing Figures

CEILING SYSTEM AND PREFABRICATED OVERHEAD BUILDING ASSEMBLY USING THIS SYSTEM

BACKGROUND OF THE INVENTION

The present invention relates generally to suspended ceiling systems and more particularly to an entire prefabricated overhead building assembly including a specific suspended ceiling system.

At the present time, one trend in the buildingindustry resides in the prefabrication of structural buildings. Generally, this does not mean that the entire building is made and assembled at the manufacturing site but rather that separate sections, for example, the walls, roof, and so on, are prefabricated at a common facility or separate facilities and thereafter transported to the ultimate building site for assembly. In many cases, it may be desirable to use suspended ceiling systems in these structural buildings. One such system is disclosed in United States Letters Patent No. 3,848,385, issued to Neil J. Thompson, the applicant of the present application, on Nov. 19, 1974. This particular system and many suspended ceiling systems generally include individual components which are assembled together to form a suspended ceiling support grid. This suspended grid is assembled together and connected to and below an overhead structure, for example, the prefabricated roof or to and below one of the intermediate floors, generally at the building site.

For various reasons, applicant has found it to be more advantageous to assemble the suspended ceiling system and connect it to the prefabricated overhead structure at the manufacturing site of the overhead structure rather than at the building site. However, applicant has recognized that to do this one specific problem must be overcome. This problem resides in transporting the joined overhead structure and suspended ceiling system from the assembly site to the building site without damaging the ceiling system. This problem is particularly worrisome where the entire prefabricated assembly is to be transported by means of truck over roads which are often not very smooth.

Obviously, there could be a number of different ways to "tie down" the suspended ceiling system to overcome the problem just discussed. However, as will be seen hereinafter, the present invention provides a unique way which is uncomplicated, economical and reliable and a way which allows the ceiling system to be "untied" and allowed to suspend from the overhead structure with minimal effort.

SUMMARY OF THE INVENTION

An object of the present invention is to provide a suspended ceiling system which can be readily secured to the underside of a prefabricated overhead building structure to substantially minimize if not eliminate both vertical and lateral movement of the ceiling system relative to the prefabricated structure, whereby to minimize damage to the overall assembly during shipment from one location to another.

Another object of the present invention is to provide a suspended ceiling system of the last mentioned type wich can be secured to the underside of the overhead building structure in an economical, uncomplicated and reliable way.

Still another object of the present invention is to provide a suspended ceiling system of the last mentioned type which, after having been secured to the overhead structure for shipment, can be readily adjusted to suspend down from the structure, with minimal effort, after the two are assembled with the remaining components of the overall building at the building site.

A further object of the present invention is to provide an entire prefabricated overhead building assembly which includes a prefabricated overhead building structure and a suspended ceiling system of the type mentioned above.

A suspended ceiling system is disclosed herein and includes a plurality of elongated support runners and a plurality of connectors adapted to connect the support runners together to form a ceiling support grid which supports, for example, ceiling tile, coffers for ceiling lights and the like. In accordance with the present invention, the suspended ceiling system also includes a number of longitudinal members, threaded bolts in the preferred embodiment, which are adapted to join the support grid with and below planer support means of a prefabricated, overhead building structure. Position means associated with and cooperating with these longitudinal members are provided for alternatively fixedly supporting the ceiling support grid at a first or "shipping" position and a second or "suspended" position. In the first position the grid is below and adjacent to the planer support means of the overhead structure, preferably tightly against the planer support means of the overhead structure to minimize if not completely eliminate both vertical and lateral movement of the support grid relative to the planer support means. In the second position the grid is below and spaced from the first position, i.e., suspended from the planer support means to support the ceiling tile, lighting coffers and the like.

In a preferred embodiment of the present invention, the longitudinal members are threaded bolts, as stated above. These bolts extend through openings in the support grid, preferably openings in the connectors comprising part of the support grid, and into openings in the planer support means of the ovehead building structure. Also in the preferred embodiment of the present invention, the position means associated with each longitudinal member, i.e., each bolt, includes an enlarged head at the bottom end of the bolt, the enlarged head resting against the bottom of the support grid, and a threaded nut threaded around the bolt and engaging the topside of the grid. In this way, the entire support grid is prevented from moving relative to and along the axis of the threaded bolts.

The position means also includes threaded means associated with and cooperating with each of the bolts for preventing free movement of the bolts through the top openings in the planer support means of the overhead structure but allowing threaded movement through the top openings. This threaded movement allows the support grid to be adjustably spaced different distances from the planer support means including directly against it. In one preferred embodiment of the present invention, these threaded means comprise threaded sections of the top openings in the planer support means, the threaded sections cooperating with the bolts to prevent the free movement just referred to but allowing the threaded movement. In another preferred embodiment of the present invention, the bolts include top segments which extend entirely through the top openings and the threaded means comprise top threaded nuts threaded around the top segments of the bolts above the planer support means and bottom threaded nuts threaded around the bolts directly below the planer support means. These top and bottom bolts are thread movable against the planer support means on both sides thereof to prevent free movement of the bolts but allow the threaded movement referred to above.

DETAILED DESCRIPTION

Figure 1:
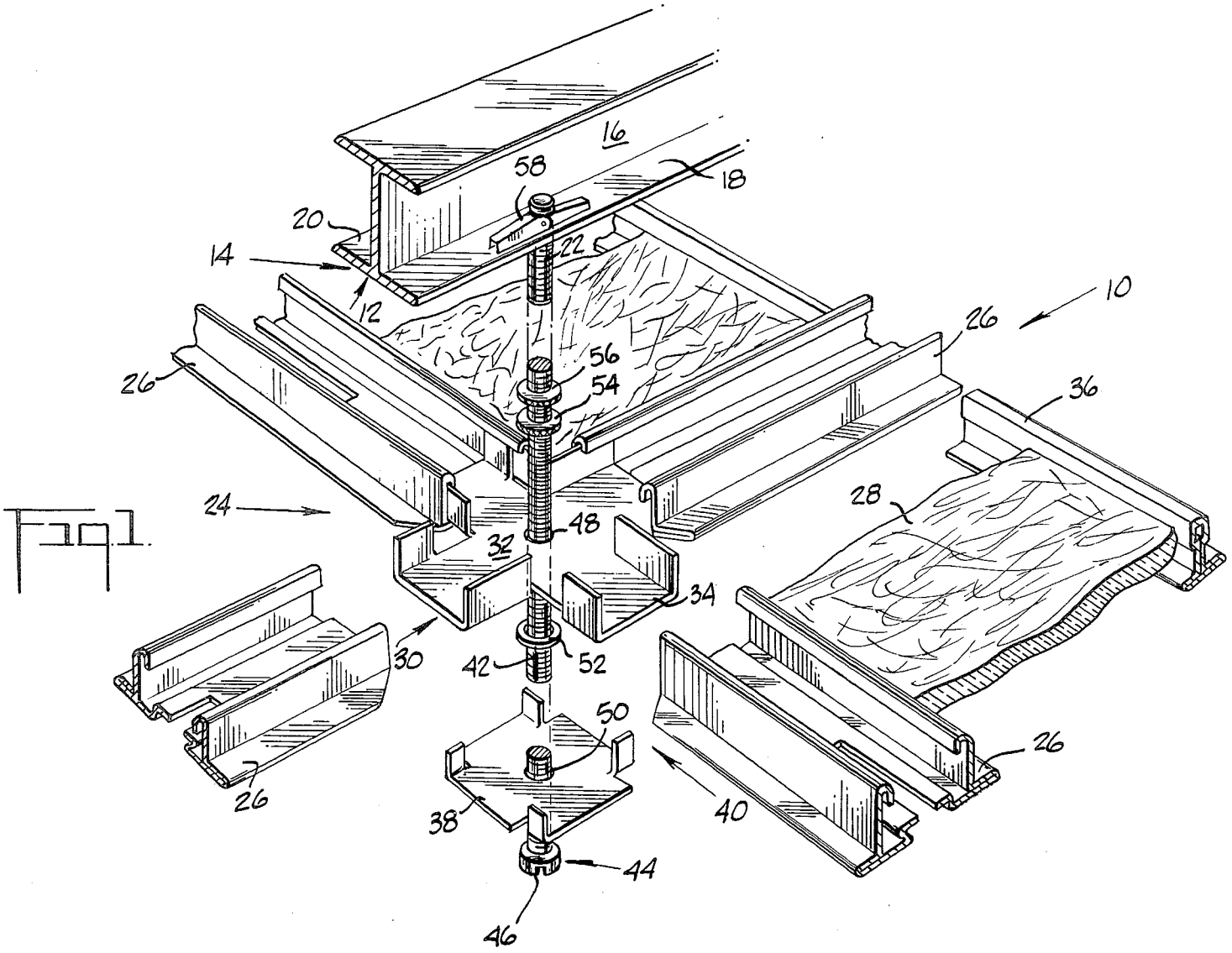
FIG. 1 is an exploded, perspective view illustrating several of the components of a prefabricated overhead building assembly constructed in accordance with the present invention.
Figure 2:
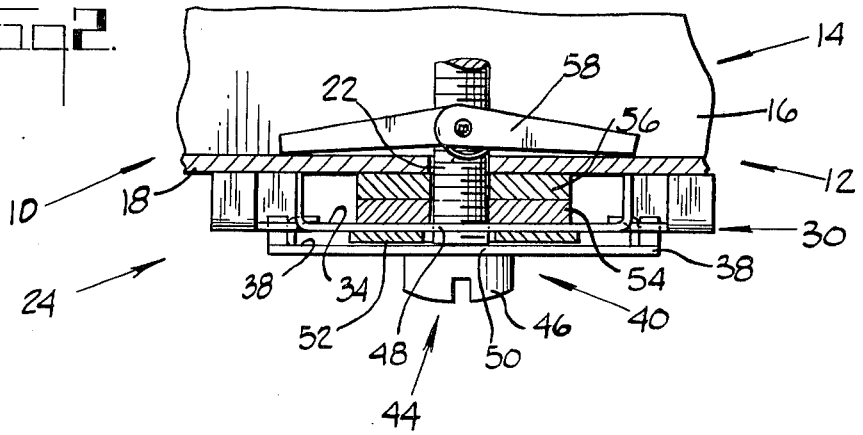
FIG. 2 is a side elevational view, partially in section, of the assembly of FIG. 1 but shown in an assembled condition and in a particular position.
Figure 3:
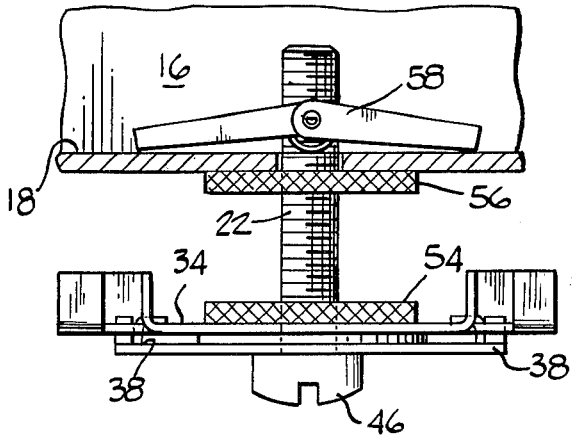
FIG. 3 is a view similar to that of FIG. 2 but showing the assembly in a second particular position.

Turning to the drawings, wherein like components are designated by like reference numerals throughout the various figures, a prefabricated overhead building assembly, constructed in accordance with the present invention, is illustrated in FIGS. 1, 2, 3 and generally designated by the reference numeral 10. Assembly 10 includes a prefabricated overhead building structure generally designated by the reference numeral 12. This overhead building structure may comprise part of an entire prefabricated building and, for example, may be a prefabricated roof structure, the top of which serves as the roof and the underside of which may serve as a ceiling of the building or, as in the case of the present invention, as part of a ceiling support. Overhead structure 12 could also be an intermediate overhead structure in a building, the topside serving as the floor for one level and the underside serving as the ceiling or part of the ceiling support for an adjacent lower level. As will be seen hereinafter, the specific construction of overhead structure 12 in assembly 10 is not pertinent per se to the present invention. The specific construction of this overhead structure will depend upon its ultimate intended use and is well known in the art or may be readily provided by those with skill in the art. Hence, the entire overhead structure has not been illustrated in the drawings.

However, one aspect of prefabricated overhead building structure 12 which is pertinent to the present invention resides in the underside supports comprising part of this structure. More specifically, overhead structure 12 includes support means, preferably planer support means which, as will be seen, are provided for supporting a suspended ceiling system therefrom. These planer support means can be of any general type which will support a suspended ceiling system. They may, for example, comprise a number of spaced roof trusses, a number of spaced I-beams, or the like.

While not intended to limit the present invention, assembly 10 and particularly overhead structure 12 is shown to include one of the many spaced I-beams which provide at least part of the underside support means for the overhead structure. This I-beam, generally indicated by the reference numeral 14, includes a vertical main section 16 and horizontal flanges 18 and 20 at the bottom end of main section 16. For reasons to become apparent hereinafter, flange 18 includes at least one cylindrical opening 22 extending entirely therethrough from its underside to its topside. In one embodiment of the present invention, as illustrated in FIGS. 1–3, this cylindrical opening is unthreaded along its entire length. In another embodiment, as will be seen with respect to FIG. 4, the opening is threaded at least along a part of its length.

Assembly 10 also includes a suspended ceiling system which is constructed in accordance with the present invention and which is generally designated by the reference numeral 24. This ceiling system is comprised of a number of conventional components including a plurality of elongated main support runners 26 which, as will be seen, are provided for supporting ceiling tiles 28 at the edges of the tiles or other known components of a suspended ceiling system, for example, lighting coffers or the like. System 24 also includes a plurality of runner connectors 30 which, with one possible exception to be discussed below, may be conventional.

As illustrated in FIG. 1, these connectors 30 which, as shown, are in the shape of a cruciform including a central portion 32 and four stub channel portions 34 extending out from the central portion are provided for connecting together the support runners 26. More specifically, these stub channel portions are provided for inter-connecting together common ends of four main runners 26, the runners, of course, being constructed to be connected in this manner. The otherwise free ends of these main runners, while not shown, are either connected to still further connectors 30 in the same manner or may be connected to a suitable end connector defining an outer edge of the entire suspended ceiling system. Once assembled together, these main runners and connectors define an overall ceiling support grid for supporting ceiling tile 28 and, as stated, possibly other typical suspended ceiling components. In this regard, the suspended ceiling system may include secondary runners 36 in addition to main runners 26. When this is the case, these secondary runners are generally connected at opposite ends with spaced main runners in a conventional manner. In addition, the system may include a coverplate 38 associated with each other. Each coverplate includes suitable means, for example, snap-in tabs for fastening to and over the bottom surface of the counter.

A detailed description of main runners, runner connectors and secondary runners suitable for use as components in suspended ceiling system 24 including a description of how these components are connected together to form a support grid is provided in the previously cited United States Letters Patent No. 3,848,385. However, as seen in this patent, the entire support grid is suspended by means of wires or cables fixedly connected at their lower ends to hangar tabs comprising part of the connectors shown in the patent. Presumably, the other ends of these wires or cables are fixedly connected to an upper plane not shown. As will be seen hereinafter, suspended ceiling system 24, particularly the support grid formed by runners 26 and 36 and connectors 30 are not connected to the overhead support means in this manner.

In accordance with the present invention, suspended ceiling system 24 includes a plurality of arrangements 40 for joining the assembled support grid below and to the planer support means of overhead structure 12. As will be seen below, these arrangements, only one of which is illustrated in the drawings, are specifically provided for alternatively fixedly supporting the assembled ceiling support grid, i.e., the main support runners 26, the connectors 30, the secondary runners 36 (if used) and the coverplates 38 (if used), in a first position in close proximity to (preferably directly against) the underside of the overhead planer support means, the underside of I beams 14 in the illustrated embodiment, and a second position spaced below this first position. In this manner, the entire suspended ceiling system an be pre-assembled and joined to prefabricated overhead building structure 12 at, for example, the manufacturing site of the overhead building structure. During transportation of the entire assembly from this site to the overall building site, the assembled ceiling support grid is held in the first position, preferably tightly against the underside of beams 14, by arrangements 40. In this way, both vertical and lateral movement of the support grid during the time in which it is being transported is minimized if not eliminated, hence minimizing if not eliminating damage to the grid during shipment. At the building site, the entire support grid can be readily removed to the second position, i.e., suspended below the beams 14 so as to support ceiling tile 28 and the like. As will also be seen, arrangement 40 includes means to fixedly support the grid at intermediate points between the two positions just discussed.

Each arrangement 40 includes a longitudinal member for joining the support grid with the planer support means, i.e., with beams 14 in the illustrated embodiment, of overhead structure 12. In the preferred embodiment of the present invention, this longitudinal member is comprised of the threaded shank 42 of a bolt 44 having an enlarged head 46 at its bottom end. As illustrated in each of FIGS. 1, 2, and 3, threaded shank 42 extends through an opening 48 provided centrally through the portion 32 of connector 30 and through previously described opening 22 in flange 18 of beam 14 such that the top segment of the threaded shaft is located above flange 18 and such that the head 46 of the bolt is located below connector 30. Where a coverplate 38 is included with each connector 30, the coverplate would also include an opening, opening 50 in the figures, and shank 42 would also extend through opening 50 as shown in FIGS. 1 to 3. A washer 52 may be provided between connector 30 and coverplate 38 and another washer (not shown) may be included between the coverplate and enlarged head 46 of the bolt. Note that the bolt shank 42 is of sufficient length to provide a substantial space between the connector 30 and planer support means, i.e., the I-beam flange, when the bolt is positioned through the openings 48 and 50 and into opening 22. The exact length of the bolt shank will, of course, depend on how much space is desired between the I-beams and grid when the latter is in the maximum suspended position.

Arrangement 40 also includes two threaded lock nuts 54 and 56 and a third threaded nut 58, preferably a toggle nut. Lowermost threaded nut 54 is thread mounted around shank 42 of bolt 44 directly above connector 30 so that it may be thread moved into engagement wih the top surface of the connector. Locknut 56 is thread mounted around the threaded shank directly over nut 54 and directly under the flange 18 of beam 14. In this manner, nut 56 can be thread moved into engagement with the bottom surface of flange 18. The toggle nut 58 is thread mounted over the uppermost segment of shank 42 directly over flange 18 so that it can be thread moved into engagement with the top surface of the flange.

Having described the components making up each of the arrangements 40, attention is specifically directed to FIGS. 2 and 3. FIG. 2 illustrates how these arrangements fixedly support the ceiling support grid in the first position referred to above, i.e., in a position directly against the underside of beams 14. FIG. 3 illustrates how these arrangements fixedly support the grid in the second position discussed above, i.e., a suspended position spaced a predetermined distance below the beams.

As seen in FIG. 2, the enlarged head 46 of bolt 44 is larger than openings 48 and 50 in connector 30 and coverplate 38 respectively and hence provides means for preventing the bolt from moving out of these openings in an upward direction towards beam 14. Stated another way, the enlarged head prevents the connector and coverplate from dropping downwardly off of the shank 42. By the same token, toggle nut 58 which is larger than opening 22 provides means for preventing shank 42 from freely moving out of opening 22 in a downward direction. Hence, with the ceiling support grid in a position below and directly against the undersides of beams 14 and with bolts 44 being located the maximum distance through openings 22, 48 and 50 such that enlarged heads 46 rest directly against the underside of connectors 30 or, in the illustrated embodiment, against coverplates 38 and with toggle nuts 58 in direct engagement with the top surfaces of flanges 18, it can be seen that the ceiling support grid is prevented from moving in either the vertical direction or the lateral direction, at least at the points in the vicinity of arrangements 40. The center connector 30 and the coverplate 38 cannot move in a downward direction because of enlarged head 46 and they cannot move in an upward direction because they are in direct engagement with flange 18. By the same token, enlarged head 46 prevents the entire bolt from moving any further upwardly and toggle nut 58 prevents it from moving downwardly. Hence, the entire suspended ceiling system is locked in place.

In order to drop the ceiling support grid to its suspended position, i.e., second position as illustrated in FIG. 3, the bolts 44 are thread moved down to the position shown in FIG. 3. Note that the two locknuts 54 and 56 were not required with the suspended ceiling system positioned against beams 14 as illustrated in FIG. 2. However, with the support grid suspended in the manner shown in FIG. 3, without these lock nuts (1) the support grid is free to move up the bolts and (2) the bolts and grid are free to move together up through openings 22. To prevent such movement and fix the support grid and bolts in the suspended position shown in FIG. 3, the locknuts 54 are thread moved downwardly into engagement with the top surfaces of connectors 30 and the locknuts 56 are thread moved upwardly into engagement with the undersides of beams 14. Hence, the nuts 54 cooperate with associated vertically aligned heads 46 of bolts 44 to prevent any movement of the support grid with respect to the bolts and nuts 56 cooperate with associated vertically aligned toggle nuts 58 to prevent any movement of the bolts and therefore the support grid with respect to the overhead planer support means, i.e., the beams 14.

If it is desirable to relocate the support grid to an intermediate position between that shown in FIG. 2 and that shown in FIG. 3, all that is necessary is that bolts 44 be thread moved further through openings 22 from the position shown in FIG. 3. In this case, adjustment of nuts 54, 56 and/or 58 may be necessary. For example, in moving the bolt up through openings 22, the toggle nuts, unless fixed to the flanges 18, would move up with the shanks of the bolts. Hence, to fix the grid system in the intermediate position, these toggles would be moved back down against the flanges. In like manner, if it is desirable to move the grid downwardly from say the intermediate position just discussed, all that would be necessary is for the bolts to be thread moved in a downward direction. In this case, it might be necessary to reposition the nuts 54 so that they again rest against the top of connectors 30.

Figure 4:
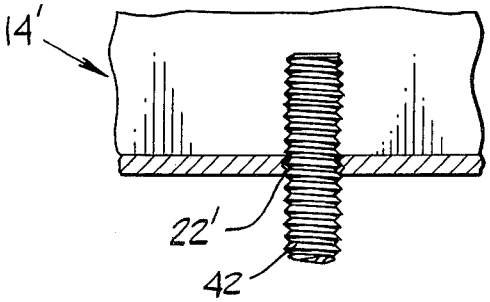
FIG. 4 is a side elevational view, partially in section, of the assembly of FIGS. 1, 2, 3, but particularly illustrating a modification of the assembly illustrated in these figures.

Having described assembly 10, attention is now directed to FIG. 4 which illustrates a slight modification to the assembly, specifically to the means by which the bolts 44 are connected to the planer support means, i.e., to beams 14. A modified beam 14′ is shown in FIG. 4 and includes a horizontal flange 18′. An opening 22′ extends entirely through flange 18′ from its underside to its topside. This opening differs from opening 22 in that opening 22′ includes at least a segment thereof, preferably its entire length, which is threaded to cooperate with the threads along shank 42. Hence, while in this embodiment like in that shown in FIGS. 1 to 3, the shank extends through opening 22′, it does so in a threaded fashion. In this way, the bolt cannot move freely through opening 22′ in either direction but can move therethrough only by means of threaded movement. In this way, it is not necessary to use either the lock nut 56 or the toggle nut 58 since the threaded engagement between opening 22′ and shank 42 provides the function of both.

Having described assembly 10 illustrated in FIGS. 1 to 3 and the modification to this assembly illustrated in FIG. 4, certain points are to be understood. First, it is not intended that the present invention be limited to the particular construction of the ceiling support grid, i.e., the runners 26, connectors 34, secondary runner 36, and so on, as illustrated herein. Second, it is not intended that the present invention be limited to the particular construction of the overhead support means, i.e., the I-beams, as illustrated herein. Any suitable ceiling support grid and overhead support means compatible with the present invention may be provided. With regard to the support grid for example, bolt 44 was shown associated with and extending through each connector. While not as practical, the runners could be provided with openings through which the bolts could pass, rather than, or in addition to, those through the connectors. In addition, while the number of arrangements 40 is preferably at least equal to the number of connectors 30 in the support grid (where the bolts pass through the connectors), the number of arrangements could be less than that of the connectors so long as they adequately support the grid in the manner described.

What I claim is:

1. A prefabricated overhead building assembly, comprising:

a. a prefabricated overhead building structure including planar support means having a plurality of spaced top openings extending therethrough;

b. a ceiling support grid positioned below and adjacent to said planer support means and including i. a plurality of elongated support runners, and ii. a plurality of connectors connecting said runners together to form said grid, said connectors including respective bottom openings extending therethrough and corresponding in number to said top openings, said bottom openings being in vertical alignment with said top openings;

c. a plurality of threaded bolts having enlarged heads and corresponding in number to said top and bottom openings, said bolts extending through respective ones of said bottom openings and into vertically aligned top openings such that the heads of said bolts lie below and adjacent said connectors, said bolts being of sufficient length to provide a predetermined maximum spacing between said planer support means and said support grid;

d. a plurality of thread nuts corresponding in number to said bolts, said nuts being thread mounted around respective ones of said bolts directly above said connectors, said nuts being thread movable against said connectors and cooperating with the heads of said bolts to prevent movement of said connectors along the lengths of said bolts; and e. threaded means associated with and cooperating with said bolts for preventing free movement of said bolts through said top openings but allowing threaded movement through the top openings, said threaded movement being provided to adjust the spacing between said planer support means and said grid.

2. A building assembly according to claim 1 wherein said threaded means comprise threaded sections of said top openings, said threaded sections cooperating with said bolts to prevent said free movement but allow said threaded movement.

3. A building assembly according to claim 1 wherein top segments of said bolts extend entirely through said top openings and wherein said threaded means comprise top threaded nuts threaded around top segments of said bolts above said planer support means and bottom threaded nuts threaded around said bolts between said planer support means and said first-mentioned nuts, said top and bottom nuts being thread movable against said planer support means to prevent said free movement but allow said thread movement of said bolts.

4. A suspended ceiling system, comprising:

a. a plurality of elongated support runners;

b. a plurality of connectors adapted to connect said support runners together to form a ceiling support grid;

c. a number of longitudinal members adapted to join said grid with and below planer support means of a prefabricated, overhead building structure; and d. position means associated with and cooperating with each of said longitudinal members for alternatively fixedly supporting said ceiling support grid at a first position below and adjacent to the planer support means of said overhead structure and a second position below and spaced from said first position.

5. A ceiling system according to claim 4 wherein said elongated members and associated position means cooperate to alternatively fixedly support said grid at said first and second positions and a plurality of intermediate positions therebetween.

6. A ceiling system according to claim 5 wherein:

a. said ceiling support grid incudes a bottom opening slightly larger than and associated with each of said longitudinal members;

b. said planer support means includes a top opening slightly larger than and associated with each of said longitudinal members;

c. each of said longitudinal member includes a bottom end segment adapted for insertion into an associated one of said bottom openings and a top end segment adapted for insertion into an associated one of said top openings; and d. each of said position means includes i. a first arrangement including means for preventing an associated longitudinal member from freely moving out of an associated top opening in a direction towards said support grid, and ii. a second arrangement including means for preventing said associated longitudinal member from freely moving out of an associated bottom opening in a direction toward said planer support means.

7. A ceiling system according to claim 6 wherein said second arrangements include second means which cooperate with the first-mentioned means of said second arrangements for preventing substantially any longitudinal movement of said ceiling support grid along the lengths of said longitudinal members when said grid is fixedly located in said second or intermediate positions.

8. A ceiling system according to claim 6 wherein the first-mentioned means of said first arrangements prevent substantially any free longitudinal movement of their associated longitudinal members through associated top opening in said planer support means.

9. A ceiling system according to claim 6 wherein said first arrangements include second means which cooperate with the first-mentioned means of said first arrangements for preventing substantially any longitudinal movement of said longitudinal members relative to said planer support when said grid is fixedly located in said second or intermediate positions.

10. A ceiling system according to claim 7 wherein:

a. each of said longitudinal members comprises the threaded shank of a bolt having an enlarged head at its bottom end;

b. said first-mentioned means of said second arrangements comprise said enlarged heads of said bolts, said heads being located below and against said support grid and around said bottom openings in said grid; and c. said second means of said second arrangements comprise threaded nuts threaded around associated shanks of said bolts between said grid and planer support means, said nuts being adapted for direct engagement with said support grid, on the side of the grid opposite said heads when said grid is in said second or intermediate positions.

11. A ceiling system according to claim 10 wherein;

a. the top segments of said bolt shanks extend entirely through said top openings;

b. said means of said first arrangement comprise threaded nuts threaded around said shanks of said bolts above said planer support means, said nuts being larger than said top openings; and c. said first arrangements include second means which cooperate with said last-mentioned nuts for preventing substantially any longitudinal movement of said bolts relative to said planer support when said grid is fixedly located in said second or intermediate positions, said second means of said first arrangements comprising threaded nuts threaded around said shanks of said bolts below said planer support means, said last-mentioned nuts being larger than said top openings.

12. A ceiling system according to claim 10 wherein said means of said first arrangement prevent substantially any free longitudinal movement of their associated bolts through associated top openings in said planer support means, said means of said first arrangement comprising threaded sections through said top openings, said threaded sections cooperating with the threads on said bolt shanks to prevent said last-mentioned free movement.

13. A ceiling system according to claim 12 wherein said bottom openings extend through said connectors.

14. A prefabricated building assembly comprising:

a. a prefabricated overhead building structure;

b. a ceiling structure grid including, i. a plurality of elongated support runners, and ii. a plurality of connectors connected to said support runners to form said ceiling support grid;

c. a number of longitudinal members joining said grid with and below said overhead structure; and d. position means associated with and cooperating with each of said longitudinal members for alternatively fixedly supporting said ceiling support grid at a first position below and adjacent to said overhead structure and a second position below and spaced from said first position.

* * * * *